US005507488A

United States Patent [19]

Eddy et al.

[11] Patent Number: 5,507,488

[45] Date of Patent: Apr. 16, 1996

[54] BALL DIVERTER FOR A PINBALL GAME

[75] Inventors: Brian R. Eddy; Robert C. Friesl, both of Chicago, Ill.

[73] Assignee: Williams Electronics Games, Inc., Chicago, Ill.

[21] Appl. No.: 406,666

[22] Filed: Mar. 20, 1995

[51] Int. Cl.[6] ..... A63F 7/30

[52] U.S. Cl. ..... 273/127 R; 273/118 R; 273/118 A; 273/121 A

[58] Field of Search ..... 273/118, 119, 273/121, 127

[56] References Cited

U.S. PATENT DOCUMENTS 4,822,046 4/1989 Kim et al. .
4,971,324 11/1990 Grabel et al. ..... 273/119 R X
4,981,298 1/1991 Lawlor et al. .
5,123,647 6/1992 Lawlor et al. ..... 273/121 A
5,358,240 10/1994 Lawlor et al. .

*Primary Examiner*—Raleigh W. Chiu
*Attorney, Agent, or Firm*—Rockey, Rifkin and Ryther

[57] ABSTRACT

A ball diverter located in a ramp or other ball path is moveable between first and second positions and is used to selectively divert a pinball between two paths. The player uses buttons located on the game cabinet to control the position of the diverter and the path travelled by the ball. The mechanism for moving the diverter includes two solenoid coils which are arranged such that the diverter can be held in either the first or second position indefinitely without either solenoid being continuously actuated.

6 Claims, 4 Drawing Sheets

BALL DIVERTER FOR A PINBALL GAME

BACKGROUND OF THE INVENTION

The invention relates, generally, to pinball games and, more particularly, to an improved player controlled ball diverter for use in such games.

Pinball games typically consist of an inclined playfield supporting a rolling ball, player operated flippers and a plurality of play features such as targets, ramps, gates and the like. The player operates the flippers to propel the ball at desired play features thereby to control play of the game.

Most pinball games include structures such as ramps, tracks and lanes to define paths of travel for the ball on the playfield. It is known in the art to provide obstructions or ball diverter gates in these paths to control the movement of the ball on the playfield and to control access to other play features. For example, U.S. Pat. No. 5,358,240 to Lawlor et al. discloses a ball diverter including a pivoting cage located above an elevated track for removing a ball from the track and depositing it on an adjacent surface. A typical ball diverter gate is shown in U.S. Pat. No. 4,981,298 to Lawlor et al. where abutting surfaces separate to create a ball channel. U.S. Pat. No. 4,822,046 to Kim et al. discloses another ball diverter wherein a rotating member includes grooves that define alternate ball paths.

It should be noted that such ball diverters are actuated by solenoids. Solenoids are in wide use in pinball games because they are relatively cheap and reliable, have fast response times and can be microprocessor controlled. When current passes through a conductive coil which is wound around a plunger in a typical solenoid, a magnetic field is created that rapidly moves the plunger from its initial position to an actuated position. When the current is removed, the plunger returns to its initial non-actuated position.

One problem with using solenoids in a typical ball diverter is that to maintain the ball diverter in a certain position, current must be continuously passed through the solenoid coil. If it remains actuated for an extended period of time, the solenoid can overheat and its effective life will be shortened.

What is desired is a solenoid actuated ball diverter which overcomes these problems and which is capable of being maintained in any position without continuous activation of the solenoids.

SUMMARY OF THE INVENTION

The play feature of the invention consists of ball diverter located in a ramp or other ball path for selectively diverting the ball to one of a plurality of alternate paths. The player uses buttons located on the game cabinet to control the position of the diverter and, therefore, the path travelled by the ball. The position of the diverter can be controlled by the game microprocessor according to its game program. The mechanism for positioning the diverter includes two solenoids which are arranged in a push-pull fashion such that the diverter can be held in either of two positions indefinitely without either solenoid being continuously actuated. In a second embodiment, the solenoid plungers are perpendicularly disposed.

DETAILED DESCRIPTION OF THE INVENTION

Figure 1:
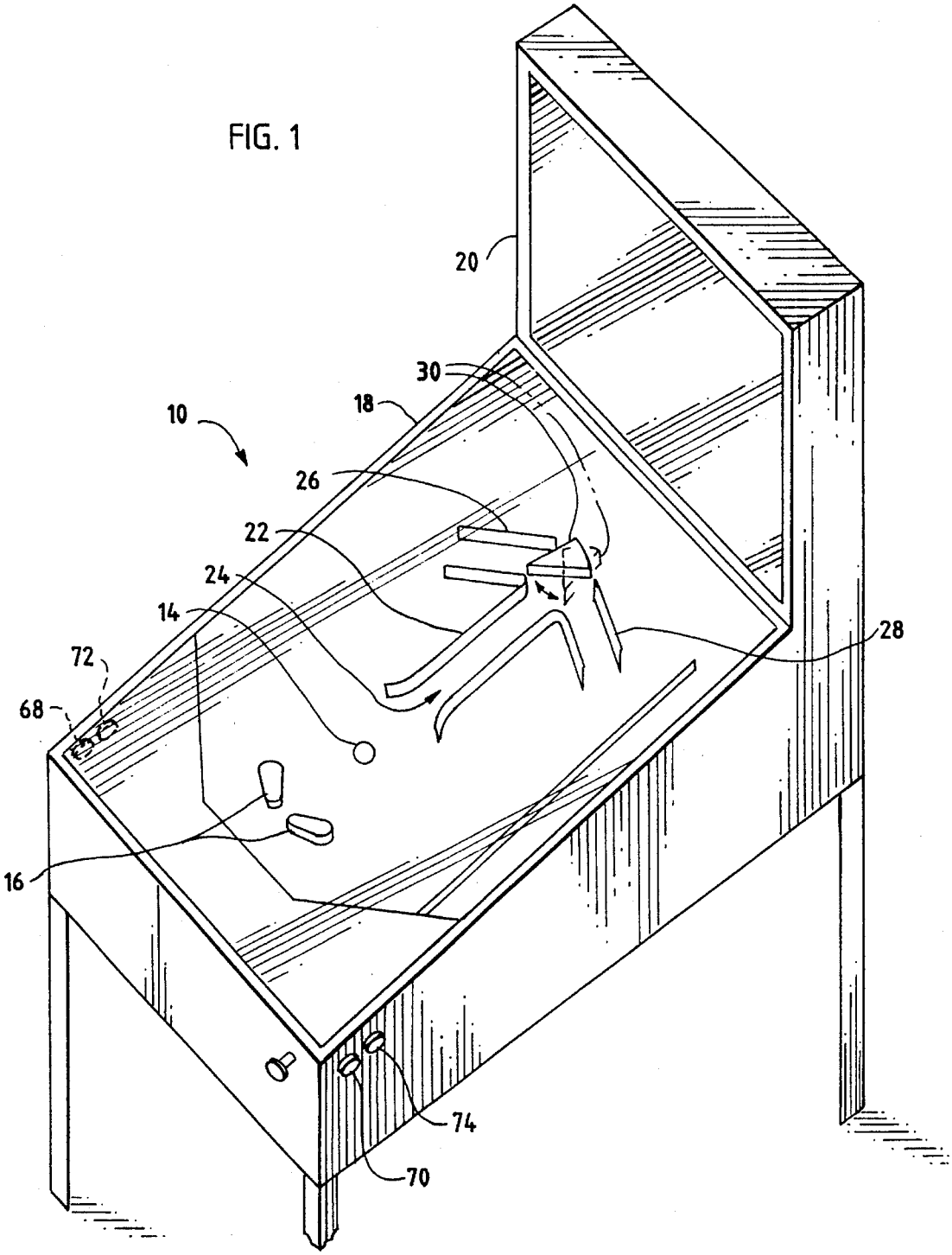
FIG. 1 is a top view of a pinball game having the ball diverter of the invention disposed on the playfield.

Referring to FIG. 1, a pinball game is shown generally at 10, the game having an inclined playfield 12 supporting a rolling ball 14, a pair of player operated flippers 16 and a plurality of play features (not shown). Playfield 12 is supported in a game cabinet 18 that supports a back box 20 for displaying scores and the like and for housing a game microprocessor and other electronics that control play of the game.

The play feature of the invention may include a ramp 22 having an entrance 24 for receiving ball 14 from playfield 12. Ramp 22 diverges into a left exit ramp 26 and a right exit ramp 8, each leading to different areas of the playfield. For example, ramps 26 and 28 could lead to specific play features, the desirability of accessing a particular feature changing during the course of game play.

A diverter 30 is located at the intersection of ramps 22, 26 and 28. Diverter 30 can pivot between a first position shown in solid line and a second position shown in dashed line in FIG. 1. In the first position, the ball is diverted from ramp 22 to ramp 28 and in the second position, the ball is diverted from ramp 22 to ramp 26.

While a specific arrangement of the invention is illustrated, it will be appreciated that the details of the construction can be altered if desired. For example, ramps 22 and 26–28 can be molded plastic ramps, wire form ramps, lanes on the playfield, other similar structures or a combination thereof. Moreover, the orientation of the ramps and branches on the playfield can be altered. It is also possible to eliminate one or both of the branches and have the diverter direct the ball directly to a play feature or back onto the playfield. Finally, the shape of diverter 30 can be modified, if desired.

Referring more particularly to FIGS. 2, 2A, 3 and 3A, a first embodiment of the mechanism for pivoting diverter 30 is described. Mechanism 32 consists of a support frame 34 fixed to the underside of the playfield 12 by flanges 36. Frame 34 supports shaft 38 for rotary motion about its longitudinal axis in a nylon sleeve or bearing 40. Shaft 38 extends through a hole 42 in the playfield 12. Diverter 30 is secured thereto and pivots about the axis of shaft 38.

Frame 34 also supports solenoid coils 44 and 46 which are axially aligned. A single plunger 48 extends between the coils and has one end slidably received in each coil such that when coil 44 is energized, plunger 48 is moved to the left and when coil 46 is energized, plunger 48 is moved to the right, as viewed in FIG. 2. Plunger 48 includes a longitudinal slot 52.

Crank arm 54 is connected to shaft 38 such that when crank arm 54 is pivoted, shaft 38 will pivot therewith. One end of the crank arm 54 extends into slot 52 and carries a slot 58 which secures the arm to plunger 48 by means of a roll pin 50. Roll pin 50 is inserted into an opening at the midpoint of plunger 48 and extends therethrough. The opposite end of crank arm 54 includes a flange 60 that is connected to one end of over-center spring 62. The opposite end of spring 62 is connected to flange 64 on frame 34. Over-center spring 62 serves to hold diverter 30 in either position shown in FIG. 3A between operation of solenoids 44 and 46.

The operation of mechanism 32 shown in FIGS. 2, 2A, 3 and 3A is set forth hereafter. Assume that the play of the game begins with diverter 30 in the solid line position shown in FIG. 1. In this position, both of solenoids 44 and 46 are deactivated, crank arm 54 is held in the solid-line position shown in FIG. 3A and diverter 30 is held in position by the force of over-center spring 62 on shaft 38 through crank arm 54.

To move diverter 30, the player presses a switch located on the game cabinet. The switch can be one of the flipper buttons 68 and 70 (FIG. 1) where one flipper button moves the diverter to the first position and the other flipper button moves the diverter to the second position. Alternatively, two additional player controlled switches 72 and 74 can provided on the game cabinet to control the play feature. Finally, a single button (i.e., switch 68) could be used such that when it is depressed, the diverter 30 will be moved from the position it occupies to the opposite position. The manipulation of the appropriate switch delivers a signal to the game microprocessor indicating that the diverter should be moved. Alternatively, diverter 30 can be controlled by the game microprocessor, independently of the player according to the game rules.

Figure 2:
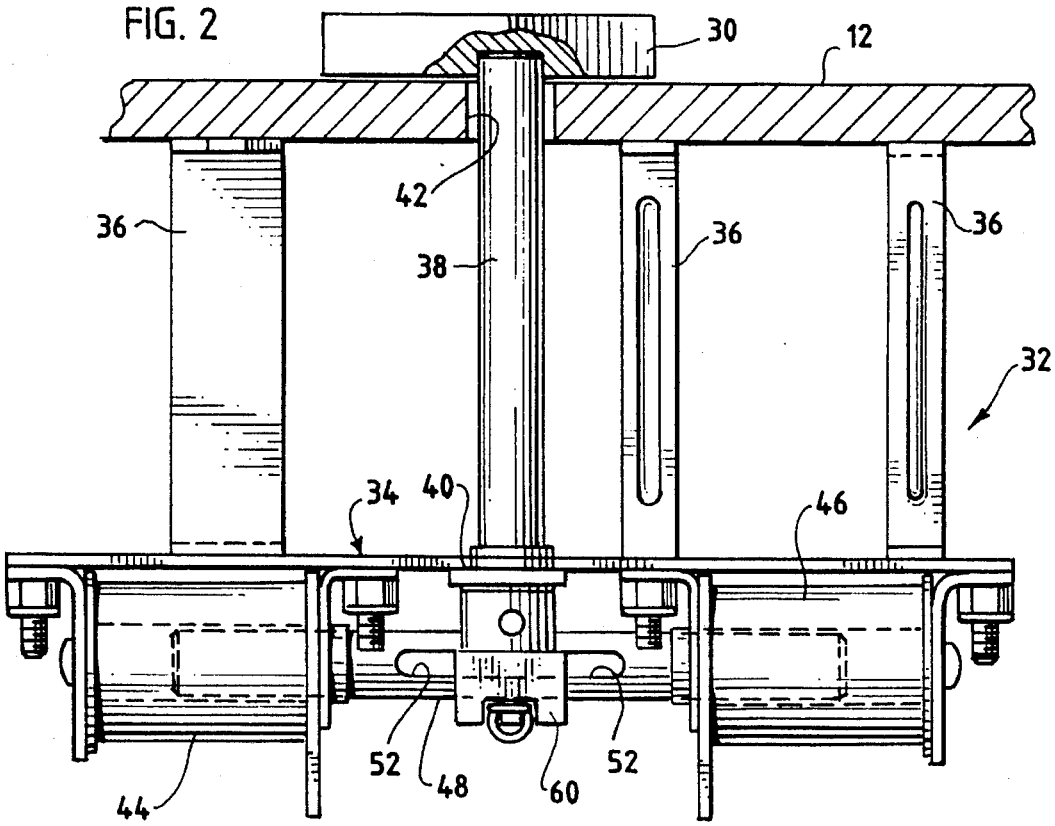
FIG. 2 is a side view of the playfield showing an embodiment of the actuating mechanism for the diverter of the invention.
Figure 2A:
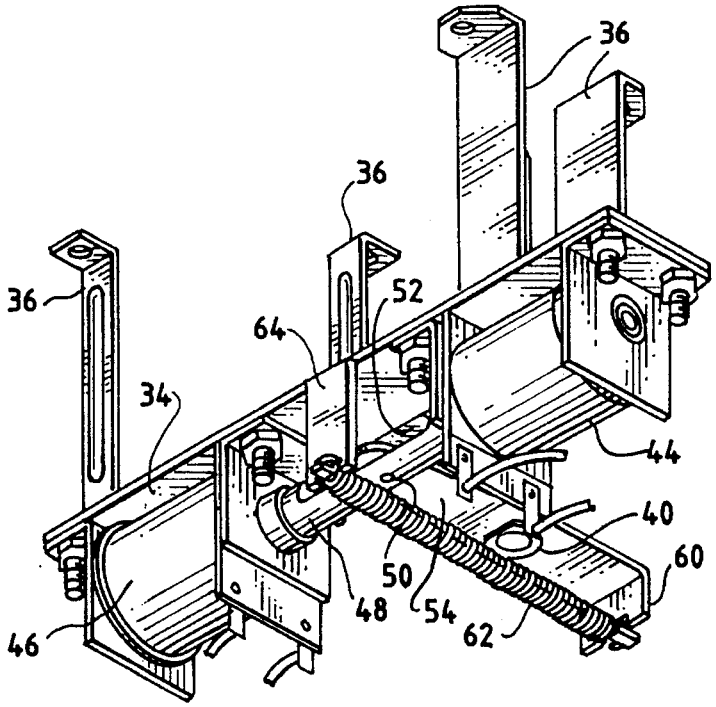
FIG. 2A is a bottom perspective view of the actuating mechanism of FIG. 2.
Figure 3:
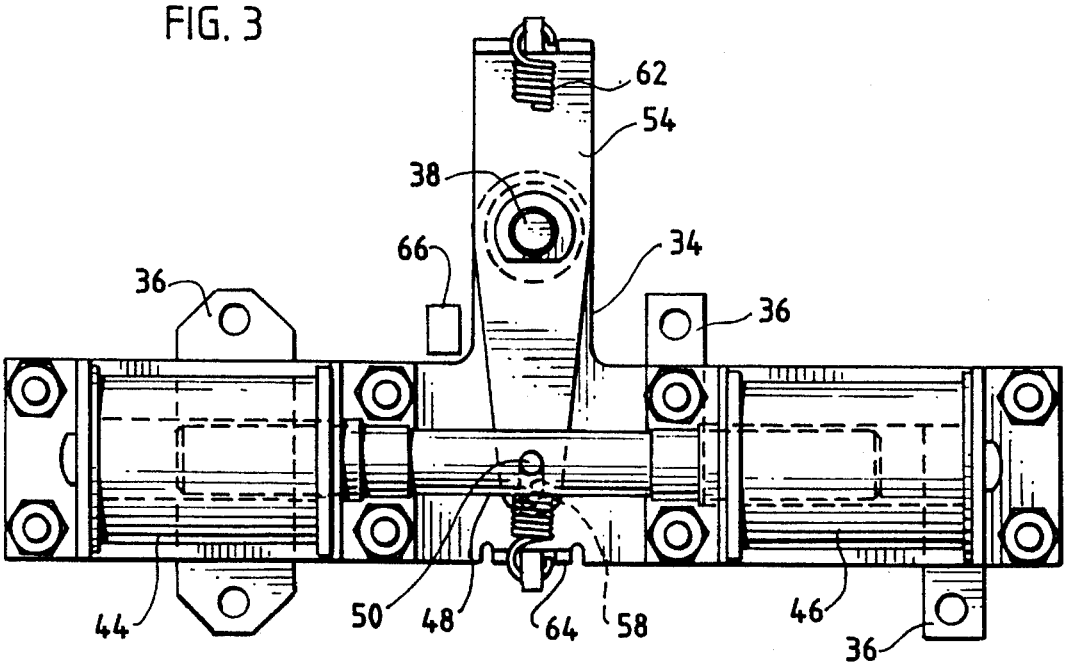
FIG. 3 is a bottom view of the actuating mechanism of FIG. 2.
Figure 3A:
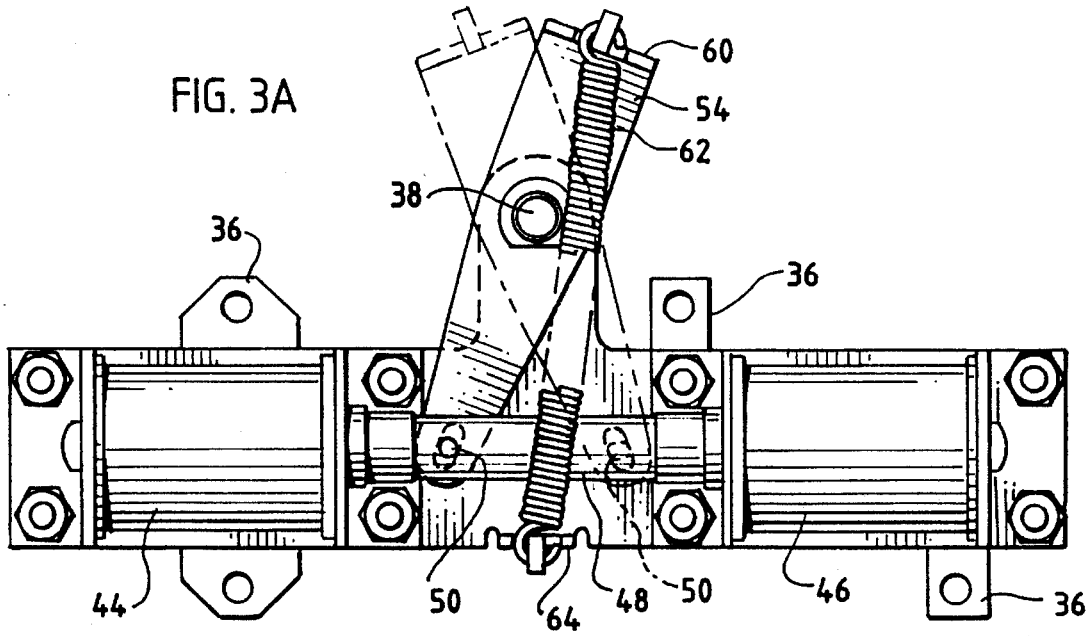
FIG. 3A is a bottom view showing the rotation of the actuating mechanism of FIG. 2.

When solenoid 46 is activated by the game microprocessor, it moves plunger 48 to the right as viewed in FIG. 2. As plunger 48 is moved, crank arm 54 is pivoted to the dashed line position of FIG. 3A due to the engagement with the roll pin 50. Diverter 30 is pivoted from the first position shown in solid line in FIG. 1 to the second position shown in dashed line in FIG. 1.

Once diverter 30 reaches the second position, solenoid 6 is deactuated. Thus, both solenoids 44 and 46 are off. The mechanism is maintained in this position by over-center spring 62 which exerts a force on crank arm 54 that holds the mechanism in position. To move the mechanism back to the first position, solenoid 44 is actuated thereby overcoming the force exerted by spring 62 to pivot crank arm 54 in the opposite direction as previously described.

Figure 4:
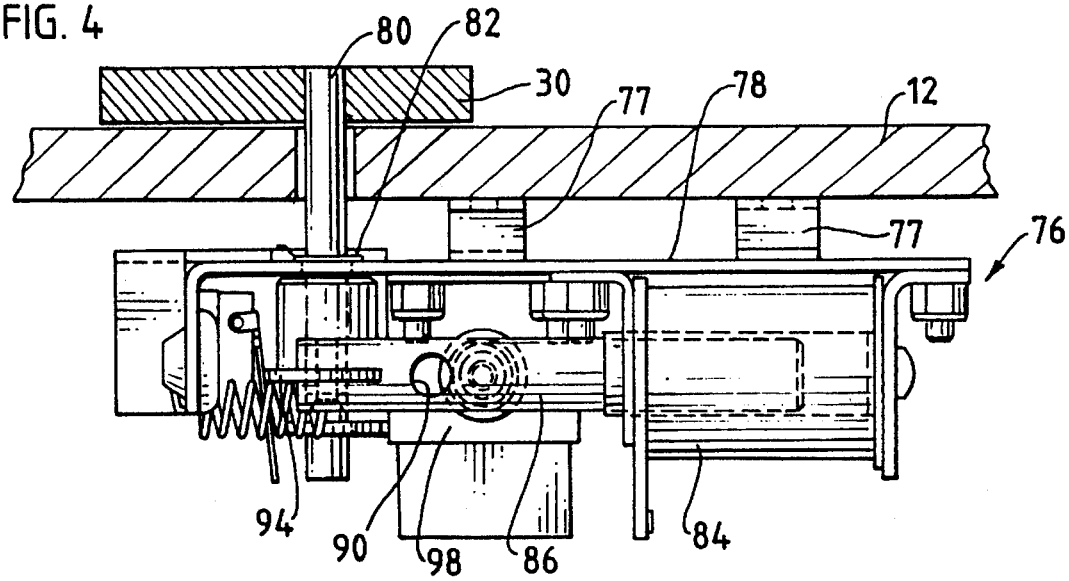
FIG. 4 is a side view showing an alternate embodiment of the actuating mechanism for the diverter of the invention.
Figure 5:
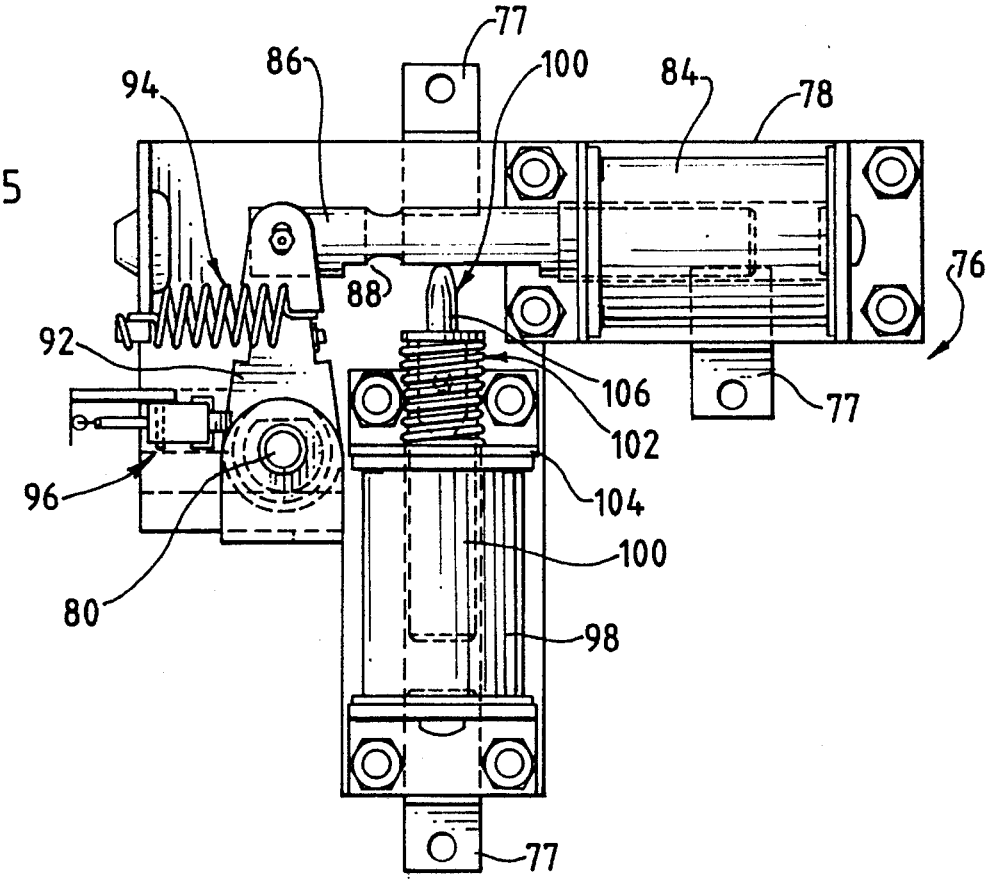
FIG. 5 is a bottom view showing the actuating mechanism of FIG. 4.

Referring to FIGS. 4 and 5, an alternate embodiment is described. Mechanism 76 consists of a support frame 78 fixed to the underside of playfield 12 by brackets 77. Frame 78 supports shaft 80 for rotary motion about its longitudinal axis in nylon sleeve 82. Shaft 80 is attached to diverter 30. Frame 78 also supports a first solenoid 84 with a movable plunger 86. Plunger 86 includes a flat surface 88 extending substantially along the length thereof and a hole 90 (FIG. 4) extending through it perpendicular to its direction of movement. Plunger 86 is connected to shaft 80 by crank arm 92 such that when plunger 86 is reciprocated, shaft 80 and diverter 30 are pivoted. Solenoid 84 is constructed such that plunger 86 will be extended (i.e., moved to the left in FIGS. 4 and 5) when the solenoid is off due to the bias of spring 94.

A second solenoid actuator 98 is also mounted on frame 80 and is arranged with its plunger 100 disposed perpendicular to plunger 86. Solenoid 98 is selected such that when current is passing through its coil, plunger 100 will be retracted, i.e., moved away from plunger 86 as viewed in FIG. 5. A spring 102 is concentrically arranged over plunger 100 and is compressed between the solenoid body 104 and a flange 106 which is fixed to plunger 100. As a result, when the solenoid 98 is not actuated, the spring 102 will extend plunger 100 into engagement with the flat face 88 of plunger 86. The end of plunger 10 is bullet shaped to engage hole 90 on plunger 86.

A switch 96 is mounted on frame 80 adjacent crank arm 92. When crank arm 92 is in position illustrated in FIGS. 4 and 5, switch 96 is closed and a corresponding signal is delivered to the game microprocessor. When crank arm 92 is pivoted by solenoid 84, switch 96 is opened. Thus, the game microprocessor is informed of the position of the mechanism.

The operation of the diverter of FIGS. 4 and 5 will now be described. Play of the game is begun with diverter 30 in either the first or second position shown in FIG. 1. Assume diverter 30 is in the second (dashed line) position. In this position, the solenoids are positioned as shown in FIGS. 4 and 5. Solenoid 84 is off and plunger 86 is held in the extended position by spring 94. Solenoid 98 is also off and its plunger 100 is held against flat surface 88 by spring 102. Switch 96 is closed thereby informing the game microprocessor that diverter 30 is in the first position.

Upon receipt of a signal from the game player indicating that the position of diverter 30 is to be changed (i.e., by depressing one of the switch buttons as previously described), the microprocessor actuates solenoid 84 to retract plunger 86. Plunger 86 retracts to a position where through hole 90 is aligned with the end of plunger 100 of solenoid 98 thereby pivoting diverter 30 to the second position. The bullet shaped end of plunger 100 enters hole 90 locking plunger 86 in the second position. Solenoid 84 is then deactuated and plunger 86 is held in the retracted position solely by the engagement of plunger 100 with hole 90.

When crank arm 92 is pivoted, switch 96 is opened signalling the game microprocessor that the position of diverter 30 has changed. Diverter 30 can be held in this position indefinitely without either of solenoids 84 or 98 being actuated.

To move the diverter from the second position back to the first position, the player depresses the appropriate button to signal the game microprocessor. Upon receipt of this signal, the game microprocessor activates solenoid 98 to momentarily retract plunger 100. The retraction of plunger 100 disengages it from hole 90 thereby allowing plunger 86 to move to the extended position under the force of spring 94.

As will be apparent, diverter 30 can be held indefinitely in either one of two positions without either solenoid remaining actuated. Moreover, to move the diverter between the first and second positions, only one of the two solenoids must be briefly actuated. Additionally, it should be understood that the requirement for player control can be eliminated and the position of the gate can be completely microprocessor-controlled.

While the invention has been described in some detail with respect to the drawings, it will be appreciated that numerous changes in the details and construction of the invention can be made without departing from the spirit and scope of the invention as set forth in the appended claims.

What is claimed is:

1. A diverter mechanism for a pinball game comprising:

a) a diverter movable between first and second positions;

b) a pair of solenoids having a common plunger operatively coupled to said diverter for moving said diverter to either of said first and second positions;

c) means for holding said diverter in either of said positions when said solenoids are not actuated; and d) control means for selectively actuating said solenoids to move the diverter between said first and second positions.

2. The diverter mechanism of claim 1 wherein said means for holding comprises an over-center spring mechanism.

3. The diverter mechanism of claim 1 wherein said control means includes a microprocessor.

4. A diverter mechanism for a pinball game including a rolling ball comprising:

a. a ball diverter moveable between first and second positions to alter ball direction;

b. a first solenoid having a first plunger having a flat face with an opening therein operatively connected to said diverter and moveable between actuated and deactuated positions, said first solenoid moving said diverter between said first and second positions;

c. means for biasing said first plunger to said deactuated position and said diverter to said first position;

d. means for holding said diverter in said second position when said first solenoid is not actuated including:

(i) a second solenoid having a second plunger disposed perpendicularly to said first plunger and moveable between extended and retracted positions;

(ii) means for biasing said second plunger to the extended position when it is not energized thereby to engage said opening in said first plunger when said first solenoid is actuated to hold said diverter in said second position;

(iii) actuation of said second solenoid retracting said second plunger to permit movement of the diverter to said first position, e. control means for selectively actuating said solenoids;

whereby said ball diverter can be held in either of said positions when said first solenoid is not actuated.

5. The diverter mechanism of claim 4 wherein said control means includes a game microprocessor.

6. The diverter mechanism of claim 4 wherein said control means includes a switch for indicating the position in which said diverter is disposed.

* * * * *